US009070502B2

(12) United States Patent
Kitajima

(10) Patent No.: US 9,070,502 B2
(45) Date of Patent: Jun. 30, 2015

(54) ELECTRONIC COMPONENT AND METHOD FOR MANUFACTURING THE SAME

(71) Applicant: MURATA MANUFACTURING CO., LTD., Kyoto (JP)

(72) Inventor: Masaki Kitajima, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/490,246

(22) Filed: Sep. 18, 2014

(65) Prior Publication Data

US 2015/0091685 A1 Apr. 2, 2015

(30) Foreign Application Priority Data

Sep. 30, 2013 (JP) ..... 2013-203402

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 27/29*** | (2006.01) |

(52) U.S. Cl.

CPC ..... *H01F 27/2804* (2013.01); *H01F 41/041* (2013.01); *H01F 27/29* (2013.01); *H01F 2027/2809* (2013.01); *H01F 5/00* (2013.01)

(58) Field of Classification Search

IPC ..... H01F 5/00,27/30, 27/28

See application file for complete search history.

(56) References Cited

U.S. PATENT DOCUMENTS

| | | | | |
|---|---|---|---|---|
| 6,437,677 | B1 * | 8/2002 | Takeuchi et al. | 336/200 |
| 2006/0068602 | A1 * | 3/2006 | Kamijima | 438/780 |
| 2014/0043129 | A1 * | 2/2014 | Wi et al. | 336/192 |

FOREIGN PATENT DOCUMENTS

| | | | |
|---|---|---|---|
| JP | 2005-217345 | A | 8/2005 |
| JP | 2012-069781 | A | 4/2012 |

* cited by examiner

*Primary Examiner* — Tuyen Nguyen

(74) *Attorney, Agent, or Firm* — Studebaker & Brackett PC

(57) ABSTRACT

An electronic component includes a first magnetic substrate provided with a first notch portion and a second notch portion, a multilayer body, a coil which includes a coil portion, a first lead portion, and a second lead portion. The first lead portion and the second lead portion are connected to the two end portions of the coil portion and overlap the first notch portion and the second notch portion, respectively. The electronic component further includes a first outer electrode and a second outer electrode, a first connection portion and a second connection portion which connect the outer electrodes to the lead portions. Particles are disposed at joint portions of the lead portions and the connection portions and have a coefficient of linear expansion smaller than the coefficients of linear expansion of the first lead portion, the second lead portion, the first connection portion, and the second connection portion.

8 Claims, 9 Drawing Sheets

ELECTRONIC COMPONENT AND METHOD FOR MANUFACTURING THE SAME

CROSS REFERENCE TO RELATED APPLICATIONS

This application claims benefit of priority to Japanese Patent Application No. 2013-203402 filed Sep. 30, 2013, the entire content of which is incorporated herein by reference.

TECHNICAL FIELD

The present technical field relates to an electronic component and a method for manufacturing the same. In particular, the present disclosure relates to an electronic component with a built-in common mode choke coil and a method for manufacturing the same.

BACKGROUND

Examples of electronic components in the related art include electronic components described in Japanese Unexamined Patent Application Publication No. 2005-217345. The electronic component includes a multilayer body in which a plurality of insulator layers are stacked, spiral inner conductors disposed on the insulator layers, and outer electrodes covering ridges extending in the stacking direction of the multilayer body. The end portion of the spiral inner conductor is led to the ridge of the multilayer body and is connected to the outer electrode.

In the electronic component described in Japanese Unexamined Patent Application Publication No. 2005-217345, a break may occur between the inner conductor and the outer electrode. In more detail, in the solder reflow step when the electronic component is mounted, the outer electrode is heated and cooled. Therefore, the outer electrode is expanded by heating and, thereafter, is shrunk by cooling. In many cases, electrically conductive materials, e.g., Cu, having relatively large coefficients of linear expansion are used as the material for the outer electrode. Consequently, a break may occur between the outer electrode and a lead conductor because of shrinkage of the outer electrode and the lead conductor during cooling.

SUMMARY

Accordingly, it is an object of the present disclosure to provide an electronic component capable of suppressing the occurrence of a break and a method for manufacturing the same.

An electronic component according to preferred embodiments of the present disclosure includes a first magnetic substrate which is in the shape of a rectangular parallelepiped having a first principal surface and a second principal surface opposite to each other and which is provided with a first notch portion and a second notch portion connecting the first principal surface and the second principal surface. A multilayer body includes a plurality of insulator layers stacked on the above-described first principal surface. A coil is disposed in the above-described multilayer body and includes a coil portion, a first lead portion, and a second lead portion. The first lead portion and the second lead portion are connected to their respective one of the two end portions of the coil portion and overlap the above-described first notch portion and the above-described second notch portion, respectively, in plan view when viewed from the stacking direction. A first outer electrode and a second outer electrode are disposed on the above-described second principal surface. A first connection portion and a second connection portion connect the above-described first outer electrode to the above-described first lead portion and the above-described second outer electrode to the above-described second lead portion, respectively, and are disposed on the inner periphery of the above-described first notch portion and the inner periphery of the above-described second notch portion. Particles are disposed at a joint portion of the above-described first lead portion and the above-described first connection portion and a joint portion of the above-described second lead portion and the above-described second connection portion and have a coefficient of linear expansion smaller than the coefficients of linear expansion of the first lead portion, the second lead portion, the first connection portion, and the second connection portion.

A method for manufacturing the above-described electronic component includes the steps of preparing a mother main body in which a mother multilayer body serving as the above-described multilayer body is disposed on the above-described first principal surface of a first mother substrate serving as the above-described first magnetic substrate, forming through holes at positions, at which the above-described first notch portion and the above-described second notch portion are to be formed, of the above-described first mother substrate by a sandblast method using the above-described particles, forming the above-described first connection portion and the above-described second connection portion by forming conductor layers on the inner peripheries of the above-described through holes, forming the above-described first outer electrode and the above-described second outer electrode by forming conductor layers on the principal surface of the above-described first mother substrate, and cutting the mother main body.

According to preferred embodiments of the present disclosure, the occurrence of a break is suppressed.

Other features, elements, characteristics and advantages of the present disclosure will become more apparent from the following detailed description of preferred embodiments of the present disclosure with reference to the attached drawings.

DETAILED DESCRIPTION

An electronic component and a method for manufacturing the same according to embodiments of the present disclosure will be described below.

Configuration of Electronic Component

Figure 1:
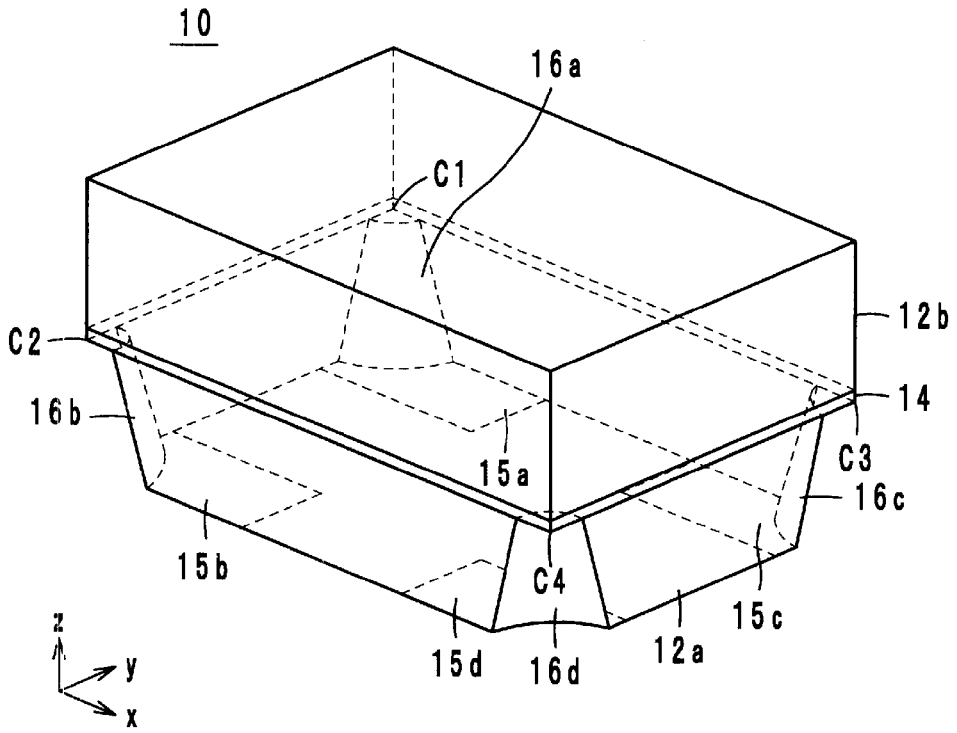
FIG. 1 is a perspective view of an appearance of an electronic component according to an embodiment.
Figure 2:
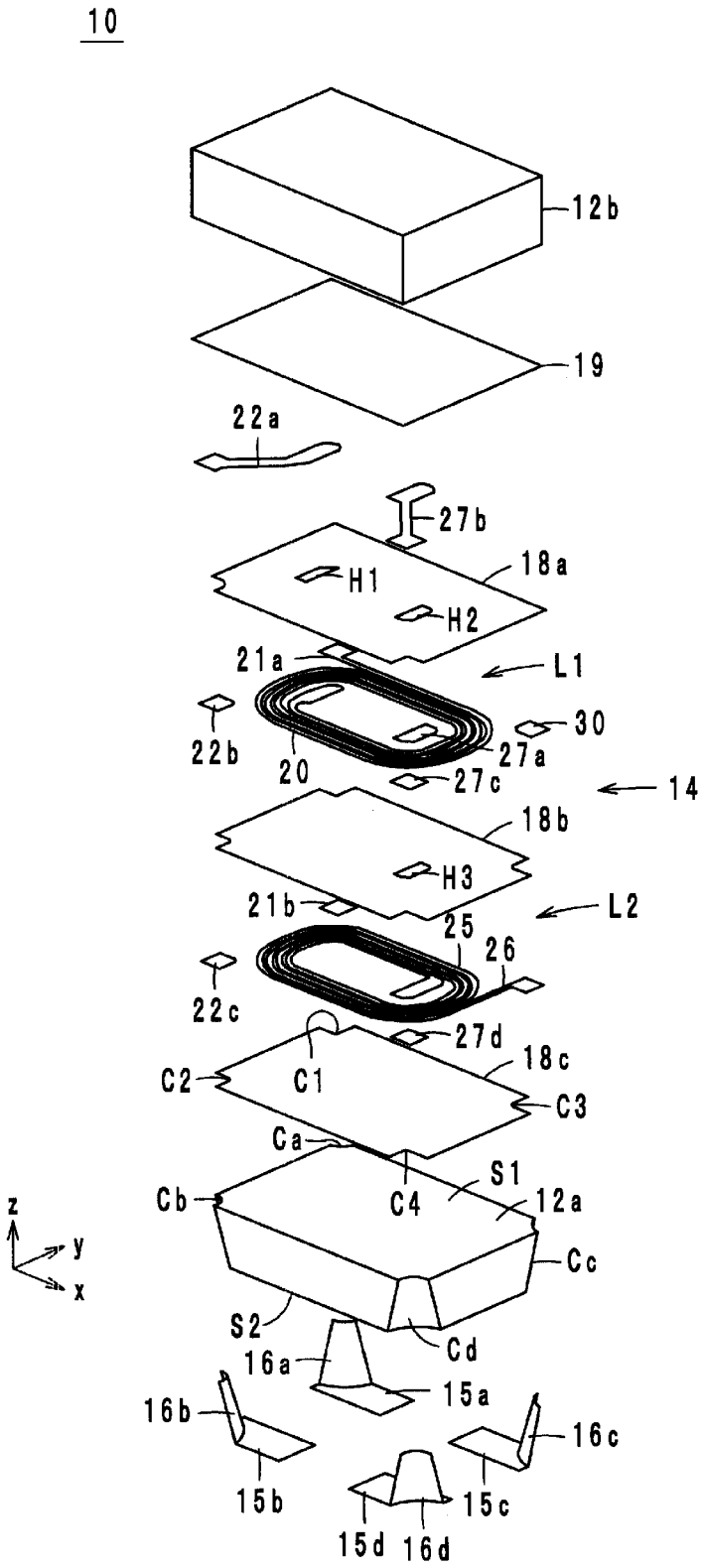
FIG. 2 is an exploded perspective view of the electronic component shown in FIG. 1.
Figure 3A:
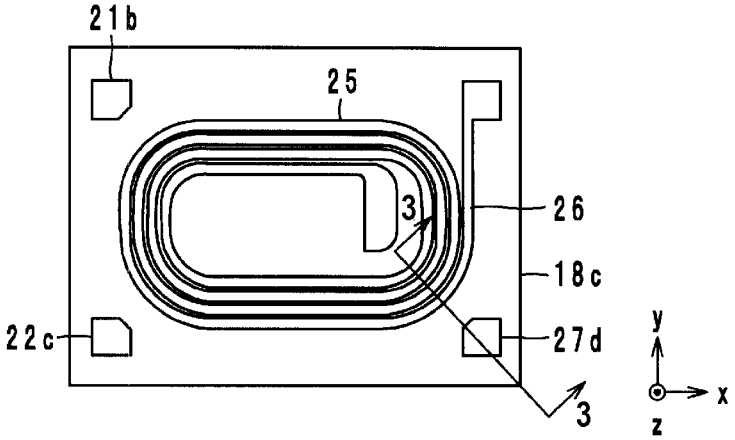
FIG. 3A is a plan view of a coil portion and an insulator layer, viewed from the z axis direction.
Figure 3B:
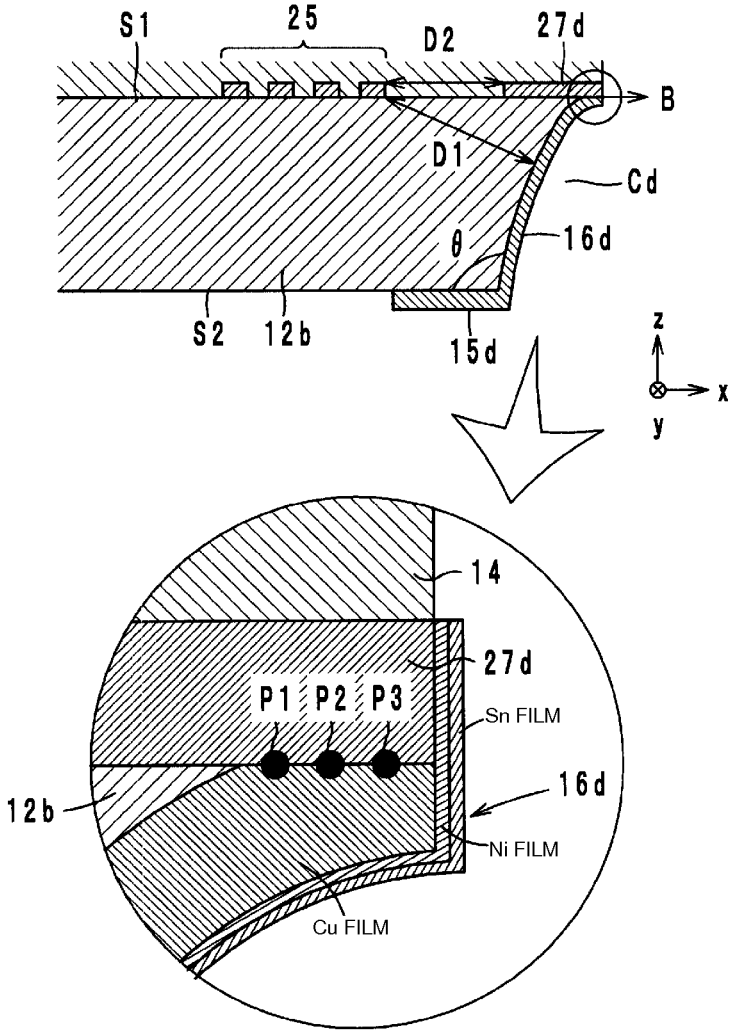
FIG. 3B is a sectional structural diagram along a line 3-3 shown in FIG. 3A.

The configuration of an electronic component according to an embodiment of the present disclosure will be described with reference to the drawings. FIG. 1 is a perspective view of an appearance of an electronic component according to an embodiment. FIG. 2 is an exploded perspective view of the electronic component 10 shown in FIG. 1. FIG. 3A is a plan view of a coil portion 25 and an insulator layer 18*c*, viewed from the z axis direction. FIG. 3B is a sectional structural diagram along a line 3-3 shown in FIG. 3A. Hereafter the stacking direction of the electronic component 10 is defined as the z axis direction, the direction in which a long side is extended in plan view when viewed from the z axis direction is defined as the x axis direction, and the direction in which a short side is extended is defined as the y axis direction. In this regard, the plan view from the positive direction side of the z axis direction is simply referred to as the plan view from the z axis direction.

As shown in FIG. 1 and FIG. 2, the electronic component 10 is provided with magnetic substrates 12*a* and 12*b*, a multilayer body 14, outer electrodes 15*a* to 15*d*, connection portions 16*a* to 16*d*, and coils L1 and L2.

The magnetic substrate 12*a* is in the shape of a rectangular parallelepiped having principal surfaces S1 and S2 opposite to each other. In the magnetic substrate 12*a*, the principal surface S1 is located on the positive direction side of the z axis direction of the principal surface S2. In this regard, the magnetic substrate 12*a* has a shape in which four ridges connecting the principal surfaces S1 and S2 have been cut by notch portions Ca to Cd. The shape of the magnetic substrate 12*a* will be described below in more detail.

The notch portions Ca to Cd refer to spaces formed by cutting the portions in the vicinity of the ridges. The notch portion Ca refers to a space formed by cutting the ridge on the negative direction side of the x axis direction and on the positive direction side of the y axis direction. The notch portion Cb refers to a space formed by cutting the ridge on the negative direction side of the x axis direction and on the negative direction side of the y axis direction. The notch portion Cc refers to a space formed by cutting the ridge on the positive direction side of the x axis direction and on the positive direction side of the y axis direction. The notch portion Cd refers to a space formed by cutting the ridge on the positive direction side of the x axis direction and on the negative direction side of the y axis direction.

The magnetic substrate 12*a* is produced by being cut from sintered ferrite ceramics. The magnetic substrate 12*a* may be produced by application of a paste formed from a ferrite calcined powder and a binder to a ceramic substrate, e.g., alumina, or be produced by stacking and firing of green sheets of ferrite material.

Portions in the vicinity of the ridges extending in the z axis direction of the magnetic substrate 12*a* are cut into substantially the shape of a temple bell (shape of a dome) tapered from the principal surface S2 toward the principal surface S1, that is, the positive direction side of the z axis direction. Therefore, the areas of the notch portions Ca to Cd in plan view when viewed from the z axis direction decreases with increasing proximity to the principal surface S1 from the principal surface S2 (toward the positive direction side of the z axis direction). In this regard, as shown in FIG. 3B, the surfaces constituting the notch portions Ca to Cd form an obtuse angle θ with the principal surface S2.

The multilayer body 14 is formed from a plurality of insulator layers 18*a* to 18*c* and an organic adhesive layer 19 layered on the principal surface S1 and is substantially in the shape of a rectangle having corner portions C1 to C4 overlapping the notch portions Ca to Cd, respectively, in plan view when viewed from the z axis direction. The insulator layers 18*a* to 18*c* are stacked sequentially in that order from the positive direction side of the z axis direction and have nearly the same size as the size of the principal surface S1. The corners located at both ends of the long side on the negative direction side of the y axis direction of the insulator layer 18*a* are notched. Via holes H1 and H2 are disposed penetrating the insulator layer 18*a* in the z axis direction. Four corners of the insulator layer 18*b* are notched. A via hole H3 is disposed penetrating the insulator layer 18*b* in the z axis direction. The via hole H3 and the via hole H2 are connected. Four corners of the insulator layer 18*c* are notched.

The insulator layers 18*a* to 18*c* are formed from polyimide. The insulator layers 18*a* to 18*c* may be formed from an insulating resin, e.g., benzocyclobutene, or be formed from an insulating inorganic material, e.g., glass ceramics. Hereafter the principal surface of each of the insulator layers 18*a* to 18*c* on the positive direction side of the z axis direction is referred to as a surface and the principal surface of each of the insulator layers 18*a* to 18*c* on the negative direction side of the z axis direction is referred to as a back.

The magnetic substrate 12*b* is in the shape of a rectangular parallelepiped and sandwiches the multilayer body 14 together with the magnetic substrate 12*a* from the z axis direction. That is, the magnetic substrate 12*b* is stacked on the positive direction side of the z axis direction of the multilayer body 14. The magnetic substrate 12*b* is produced by being cut from sintered ferrite ceramics. The magnetic substrate 12*b* may be produced by application of a paste formed from a ferrite calcined powder and a binder to a ceramic substrate, e.g., alumina, or be produced by stacking and firing of green sheets of ferrite material.

The magnetic substrate 12*b* and the multilayer body 14 may be bonded with an adhesive. In the present embodiment, the magnetic substrate 12*b* and the multilayer body 14 are bonded with the organic adhesive layer 19.

The coil L1 is disposed in the multilayer body 14 and includes a coil portion 20, lead portions 21*a* and 21*b*, and lead portions 22*a* to 22*c*. The coil portion 20 is disposed on the surface of the insulator layer 18*b* and is substantially in the shape of a spiral which approaches the center while circling clockwise in plan view when viewed from the z axis direction. The center of the coil 20 substantially coincides with the center (point of intersection of diagonals) of the electronic component 10 in plan view when viewed from the z axis direction.

The lead portion 21*a* is disposed on the surface of the insulator layer 18*b* and is connected to the outer side end portion of the coil portion 20. Also, the lead portion 21*a* is led to the notched portion of the corner on the negative direction side of the x axis direction and on the positive direction side of the y axis direction of the insulator layer 18*b*. The lead portion 21*a* penetrates the insulator layer 18*b* in the z axis direction through the notched portion.

The lead portion 21*b* is a substantially tetragonal conductor disposed in the notched portion of the corner on the negative direction side of the x axis direction and on the positive direction side of the y axis direction of the insulator layer 18*c*. Consequently, the lead portion 21*b* is connected to the lead portion 21*a*. The lead portion 21*b* penetrates the insulator layer 18*c* in the z axis direction through the notched portion.

The lead portions 21*a* and 21*b* configured as described above are connected to the end portion of the coil portion 20 and are led to the corner C1 of the principal surface on the negative direction side of the z axis direction of the multilayer body 14. Consequently, the lead portion 21*b* is exposed at the notch portion Ca in plan view when viewed from the negative direction side of the z axis direction.

The lead portion 22*a* is disposed on the surface of the insulator layer 18*a* and is connected to the inner side end portion of the coil portion 20 by penetrating the insulator layer 18*a* in the z axis direction through the via hole H1. Also, the lead portion 22*a* is led to the notched portion of the corner on the negative direction side of the x axis direction and on the negative direction side of the y axis direction of the insulator layer 18*a*. The lead portion 22*a* penetrates the insulator layer 18*a* in the z axis direction through the notched portion.

The lead portion 22*b* is a substantially tetragonal conductor disposed in the notched portion of the corner on the negative direction side of the x axis direction and on the negative direction side of the y axis direction of the insulator layer 18*b*. Consequently, the lead portion 22*b* is connected to the lead portion 22*a*. The lead portion 22*b* penetrates the insulator layer 18*b* in the z axis direction through the notched portion.

The lead portion 22*c* is a substantially tetragonal conductor disposed in the notched portion of the corner on the negative direction side of the x axis direction and on the negative direction side of the y axis direction of the insulator layer 18*c*. Consequently, the lead portion 22*c* is connected to the lead portion 22*b*. The lead portion 22*c* penetrates the insulator layer 18*c* in the z axis direction through the notched portion.

The lead portions 22*a* to 22*c* configured as described above are connected to the end portion of the coil portion 20 and are led to the corner C2 of the principal surface on the negative direction side of the z axis direction of the multilayer body 14. Consequently, the lead portion 22*c* is exposed at the notch portion Cb in plan view when viewed from the negative direction side of the z axis direction.

The coil portion 20 and the lead portions 21*a*, 21*b*, and 22*a* to 22*c* are produced through film formation of Cu by a sputtering method. The coil portion 20 and the lead portions 21*a*, 21*b*, and 22*a* to 22*c* may be produced from a material, e.g., Ag or Au, having high electrical conductivity.

The coil L2 is disposed in the multilayer body 14 and includes a coil portion 25, a lead portion 26 (third lead portion), and lead portions 27*a* to 27*d* (fourth lead portion). The coil portion 25 is disposed on the surface of the insulator layer 18*c* and is substantially in the shape of a spiral which approaches the center while circling clockwise in plan view when viewed from the z axis direction. That is, the coil portion 25 circles in the same direction as the direction of the coil portion 20. The center of the coil portion 25 substantially coincides with the center (point of intersection of diagonals) of the electronic component 10 in plan view when viewed from the z axis direction. Therefore, the coil portion 25 overlaps the coil portion 20 in plan view when viewed from the z axis direction. Furthermore, the coil portion 25 is disposed on the negative direction side of the z axis direction (near to the magnetic substrate 12*a*) of the coil portion 20. Consequently, the coil L2 constitutes a common mode choke coil together with the coil L1.

The lead portion 26 is disposed on the surface of the insulator layer 18*c* and is connected to the outer side end portion of the coil portion 25. Also, the lead portion 26 is led to the notched portion of the corner on the positive direction side of the x axis direction and on the positive direction side of the y axis direction of the insulator layer 18*c*. The lead portion 26 penetrates the insulator layer 18*c* in the z axis direction through the notched portion.

The lead portion 26 configured as described above are connected to the end portion of the coil portion 25 and is led to the corner C3 of the principal surface on the negative direction side of the z axis direction of the multilayer body 14. Consequently, the lead portion 26 is exposed at the notch portion Cc in plan view when viewed from the negative direction side of the z axis direction.

The lead portion 30 is a substantially tetragonal conductor disposed in the notched portion of the corner on the positive direction side of the x axis direction and on the positive direction side of the y axis direction of the insulator layer 18*b*. Consequently, the lead portion 30 is connected to the lead portion 26.

The lead portion 27*a* is disposed on the surface of the insulator layer 18*b* and is a substantially tetragonal conductor connected to the inner side end portion of the coil portion 25 by penetrating the insulator layer 18*b* in the z axis direction through the via hole H3.

The lead portion 27*b* is disposed on the surface of the insulator layer 18*a* and is connected to the lead portion 27*a* by penetrating the insulator layer 18*a* in the z axis direction through the via hole H2. The lead portion 27*b* is led to the notched portion of the corner on the positive direction side of the x axis direction and on the negative direction side of the y axis direction of the insulator layer 18*a*. The lead portion 27*b* penetrates the insulator layer 18*a* in the z axis direction through the notched portion.

The lead portion 27*c* is a substantially tetragonal conductor disposed in the notched portion of the corner on the positive direction side of the x axis direction and on the negative direction side of the y axis direction of the insulator layer 18*b*. Consequently, the lead portion 27*c* is connected to the lead portion 27*b*. The lead portion 27*c* penetrates the insulator layer 18*b* in the z axis direction through the notched portion.

The lead portion 27*d* is a substantially tetragonal conductor disposed in the notched portion of the corner on the positive direction side of the x axis direction and on the negative direction side of the y axis direction of the insulator layer 18*c*. Consequently, the lead portion 27*d* is connected to the lead portion 27*c*. The lead portion 27*d* penetrates the insulator layer 18*c* in the z axis direction through the notched portion.

The lead portions 27*a* to 27*d* configured as described above are connected to the end portion of the coil portion 25 and are led to the corner C4 of the principal surface on the negative direction side of the z axis direction of the multilayer body 14. Consequently, the lead portion 27*d* is exposed at the notch portion Cd in plan view when viewed from the negative direction side of the z axis direction.

The coil portion 25 and the lead portions 26 and 27*a* to 27*d* are produced through film formation of Cu by a sputtering method. The coil portion 25 and the lead portions 26 and 27*a* to 27*d* may be produced from a material, e.g., Ag or Au, having high electrical conductivity.

The outer electrodes 15*a* to 15*d* are disposed on the principal surface S2 of the magnetic substrate 12*a* and together are rectangular. In more detail, the outer electrode 15*a* is disposed in the vicinity of the corner on the negative direction side of the x axis direction and on the positive direction side of the y axis direction of the principal surface S2. The outer electrode 15*b* is disposed in the vicinity of the corner on the negative direction side of the x axis direction and on the negative direction side of the y axis direction of the principal surface S2. The outer electrode 15*c* is disposed in the vicinity of the corner on the positive direction side of the x axis direction and on the positive direction side of the y axis direction of the principal surface S2. The outer electrode 15*d* is disposed in the vicinity of the corner on the positive direction side of the x axis direction and on the negative direction side of the y axis direction of the principal surface S2. The outer electrodes 15*a* to 15*d* are produced by forming and stacking an Au film, a Ni film, a Cu film, and a Ti film in that order from the lower layer to the upper layer by the sputtering method. The surface of the outer electrodes 15*a* to 15*d* is subjected to Ni plating and Sn plating. In this regard, the outer electrodes 15*a* to 15*d* may be formed by printing and baking of a paste containing a metal, e.g., Cu, or be produced through formation of a film of Cu or the like by an evaporation or plating method.

The connection portions 16*a* to 16*d* connect the outer electrodes 15*a* to 15*d* to the lead portions 21*b*, 22*c*, 26, and 27*d*, respectively, and are disposed on the inner peripheries of the notch portions Ca to Cd. The connection portions 16*a* to 16*d* cover the inner peripheries constituting the notch portions Ca to Cd, respectively. The connection portions 16*a* to 16*d* may be produced by forming and stacking a conductor film containing Ti as a primary component and a conductor film containing Cu as a primary component in that order from the lower layer to the upper layer by the plating method. The connection portions 16*a* to 16*d* may be produced from a material, e.g., Ag or Au, having high electrical conductivity.

The positional relationship between the coil portion 25, the lead portions 21*b*, 22*c*, 26, and 27*d*, and the connection portions 16*a* to 16*d* will be described with reference to the drawings.

As shown in FIGS. 3A and 3B, the minimum distance D1 between the coil portion 25 and the connection portion 16*d* is larger than the minimum distance D2 between the coil portion 25 and the lead portion 27*d*. The minimum distance D1 between the coil portion 25 and the connection portion 16*a* is larger than the minimum distance D2 between the coil portion 25 and the lead portion 21*b*. The minimum distance D1 between the coil portion 25 and the connection portion 16*b* is larger than the minimum distance D2 between the coil portion 25 and the lead portion 22*c*. The minimum distance D1 between the coil portion 25 and the connection portion 16*c* is larger than the minimum distance D2 between the coil portion 25 and the lead portion 26.

Furthermore, as shown in FIG. 3B, the coil portions 20 and 25 (the coil portion 20 is not shown in the drawing) do not overlap the connection portions 16*a* to 16*d* (the connection portions 16*a* to 16*c* are not shown in the drawing) in plan view when viewed from the z axis direction.

As shown in FIG. 3B, the electronic component 10 further includes particles P1 to P3. The particles P1 to P3 are particles of an inorganic material (alumina or SiC) disposed at the joint portion of the lead portion 27*d* and the connection portion 16*d*. The lead portion 27*d* and the connection portion 16*d* are produced from, for example, Cu. The coefficient of linear expansion of alumina or SiC is smaller than the coefficient of linear expansion of Cu. Therefore, the coefficient of linear expansion of the particles P1 to P3 is smaller than the coefficients of linear expansion of the lead portion 27*d* and the connection portion 16*d*. The particles P1 to P3 are substantially in the shape of a sphere and the average particle diameter of the particles P1 to P3 is about 1 μm. In this regard, although the particles P1 to P3 are shown in FIG. 3B, many other particles are present in practice.

Also, particles are disposed at joint portions of the lead portions 21*b*, 22*c*, and 26 and the connection portions 16*a*, 16*b*, and 16*c* as with the joint portion of the lead portion 27*d* and the connection portion 16*d*.

The action of the electronic component 10 configured as described above will be described below. The outer electrodes 15*a* and 15*c* are used as input terminals. The outer electrodes 15*b* and 15*d* are used as output terminals.

Differential transmission signals composed of a first signal and a second signal, where the phase difference is 180°, are input to the outer electrodes 15*a* and 15*c*, respectively. The first signal and the second signal are in the differential mode and, therefore, generate magnetic fluxes in the directions opposite to each other in a coil L1 and L2 when passing through the coils L1 and L2. Then, the magnetic flux generated in the coil L1 and the magnetic flux generated in the coil L2 cancel each other out. Consequently, increase or decrease in magnetic flux due to passing of the first and second current hardly occur in the coils L1 and L2. That is, the coils L1 and L2 hardly generate a counter electromotive force to hinder passing of the first signal and the second signal. Therefore, the electronic component 10 has a very small impedance with respect to the first signal and the second signal.

On the other hand, in the case where common mode noises are included in the first signal and the second signal, the common mode noises generate magnetic fluxes in the same direction in the coils L1 and L2 when passing through the coils L1 and L2. Consequently, the magnetic fluxes in the coils L1 and L2 increase by passing of the common mode noises. According to this, the coils L1 and L2 generate a counter electromotive force to hinder passing of the common mode noise. Therefore, the electronic component 10 has a large impedance with respect to the first signal and the second signal.

Method for Manufacturing Electronic Component

A method for manufacturing the electronic component 10 will be described below with reference to the drawings. FIG. 4A to FIG. 7D are sectional views showing steps in production of the electronic component 10.

Initially, as described below, a mother main body 110 is prepared, where a mother multilayer body 114 (refer to FIGS. 4A to 4C) serving as the multilayer body 14 is disposed on the principal surface S1 of a mother substrate 112*a* (refer to FIGS. 4A to 4C) serving as the magnetic substrate 12*a* and a mother substrate 112*b* (refer to FIGS. 4A to 4C) serving as the magnetic substrate 12*b* is disposed on the mother multilayer body 114.

Specifically, a polyimide resin serving as a photosensitive resin is applied all over the principal surface S1 of the mother substrate 112*a*. The positions corresponding to four corners of the insulator layer 18*c* are shielded from light and exposure is performed. Consequently, the polyimide resin in a portion not shielded from light is cured. Thereafter, a photoresist is removed with an organic solvent and, in addition, development is performed to remove an uncured polyimide resin. Thermosetting is performed and, thereby, the insulator layer 18*c* is formed.

A Cu film is formed on the insulator layer 18*c* by the sputtering method. A photoresist is formed on the portions to be provided with the coil portion 25 and the lead portions 21*b*, 22*c*, 26, and 27*d*. The Cu film on the portion other than the portions to be provided with the coil portion 25 and the lead portions 21*b*, 22*c*, 26, and 27*d* (that is, the portions covered with the photoresist) is removed. Thereafter, the photoresist is removed with an organic solvent, so that the coil portion 25 and the lead portions 21*b*, 22*c*, 26, and 27*d* are formed.

The same steps as those described above are repeated, so that the insulator layers 18*a* and 18*b*, the coil portion 20, and the lead portions 21*a*, 21*b*, 22*a*, 22*b*, 27*a* to 27*c*, and 30 are formed.

Figure 4A:
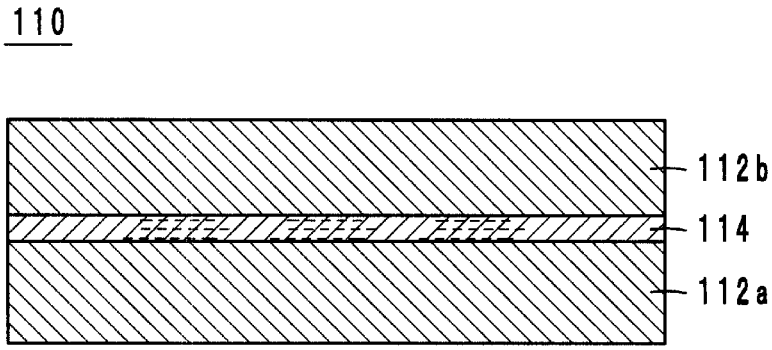
FIGS. 4A to 4C are sectional views showing steps in production of the electronic component.

The mother substrate 112*b* is bonded to the mother multilayer body 114 with a thermosetting organic adhesive layer 19. In this manner, the mother main body 110 shown in FIG. 4A is obtained.

Figure 4B:
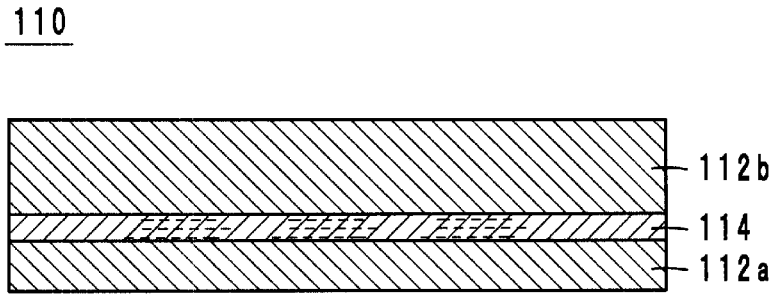

As shown in FIG. 4B, the principal surface on the negative direction side of the z axis direction of the mother substrate 112*a* is ground or polished.

Figure 4C:
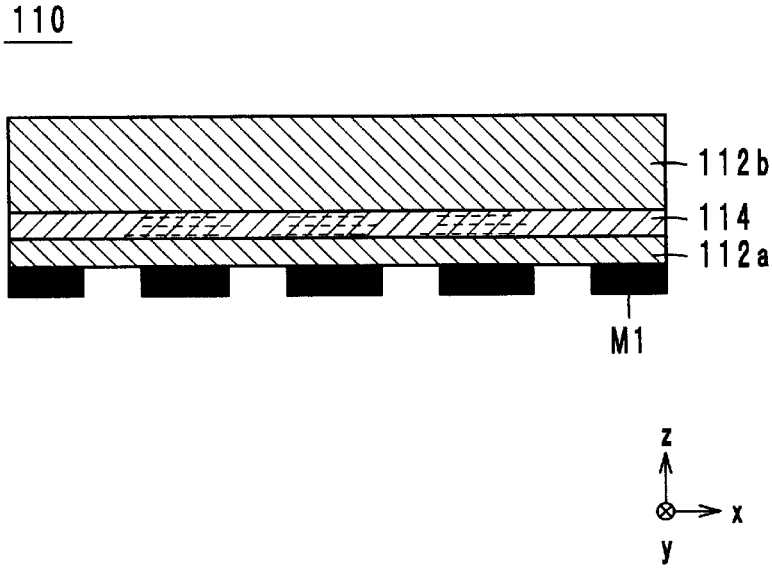

As shown in FIG. 4C, a photoresist M1 is formed on the principal surface on the negative direction side of the z axis direction of the mother substrate 112*a*, where alignment with the coils L1 and L2 in the mother multilayer body 114 is performed. The photoresist M1 has openings in regions to be provided with the notch portions Ca to Cd.

Figure 5A:
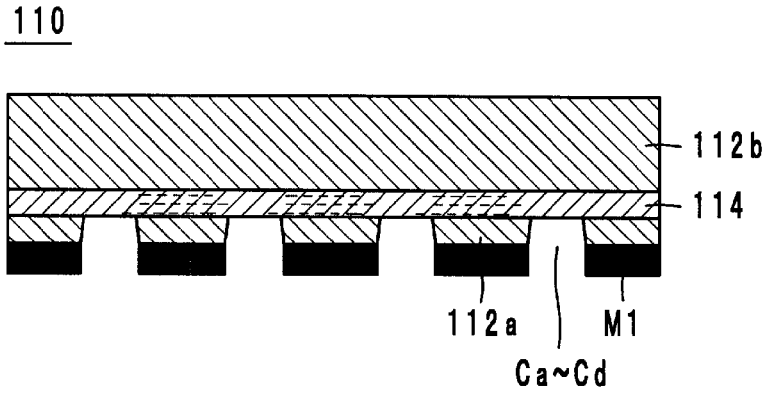
FIGS. 5A to 5C are sectional views showing steps in production of the electronic component.

As shown in FIG. 5A, through holes are formed at positions, at which the notch portions Ca to Cd are to be formed, of the mother substrate 112*a* through the photoresist M1 by a sandblast method. In the sandblast method, particles of inorganic material (alumina or SiC) are used. The average particle diameter of the particles is about 10 μm. The lead portions 21*b*, 22*c*, 26, and 27*d* are exposed at the bottom of the through holes. In this regard, small amounts of particles remain in the bottom of the through holes and on the lead portions 21*b*, 22*c*, 26, and 27*d*. The average particle diameter of the remaining particles is about 1 μm because particles have been pulverized in the sandblast step.

Figure 5B:
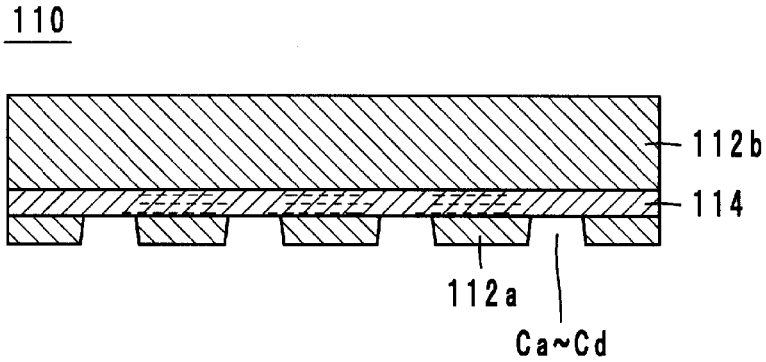

As shown in FIG. 5B, the photoresist M1 is removed with an organic solvent.

Figure 5C:
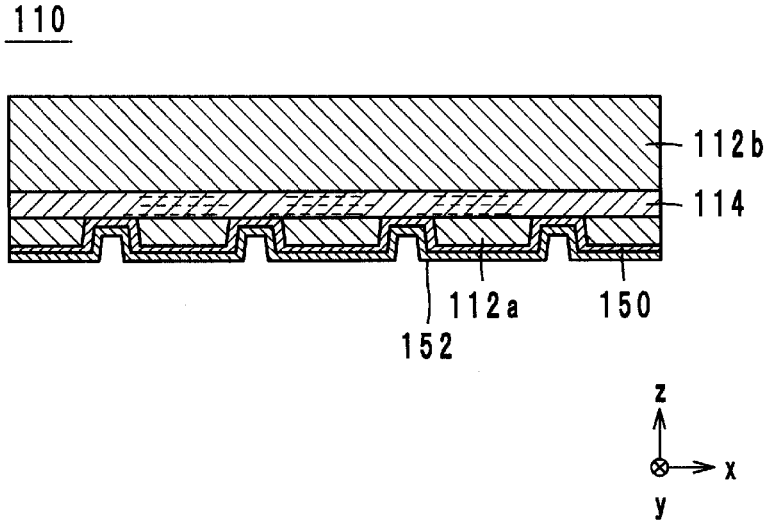

As shown in FIG. 5C, a Ti thin film 150 and a Cu thin film 152 are formed all over the principal surface on the negative direction side of the z axis direction of the mother main body 110 by the sputtering method.

Figure 6A:
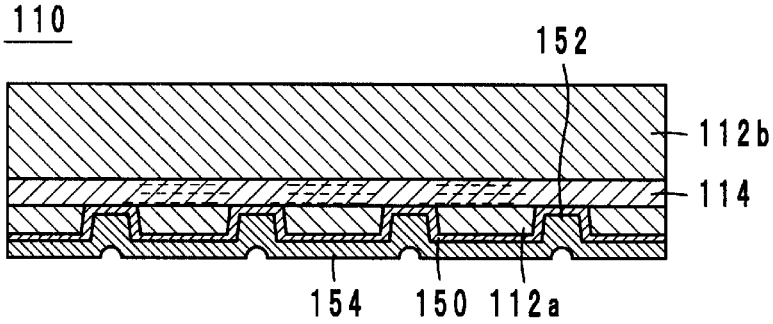
FIGS. 6A to 6D are sectional views showing steps in production of the electronic component.

As shown in FIG. 6A, the Ti thin film 150 and the Cu thin film 152 are used as power supply films and a Cu plating film 154 is formed by an electric field plating method.

Figure 6B:
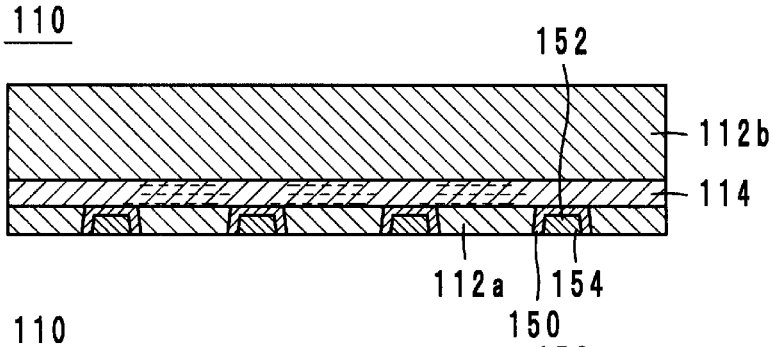

As shown in FIG. 6B, the Ti thin film 150, the Cu thin film 152, and the Cu plating film 154 formed in portions other than the through holes are removed by wet etching, grinding, polishing, CMP, or the like. Consequently, the principal surface on the negative direction side of the z axis direction of the mother main body 110 is planarized. The connection portions 16*a* to 16*d* are formed by forming conductor layers in the through holes by the steps shown in FIG. 5C to FIG. 6B.

Figure 6C:
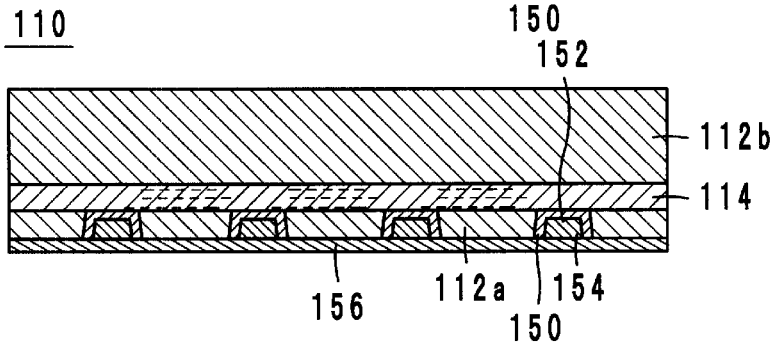

As shown in FIG. 6C, a conductor layer 156, in which a Ti film, a Cu film, a Ni film, and an Au film are stacked in that order from the lower layer to the upper layer, is formed all over the principal surface on the negative direction side of the z axis direction of the mother main body 110 by the sputtering method.

Figure 6D:
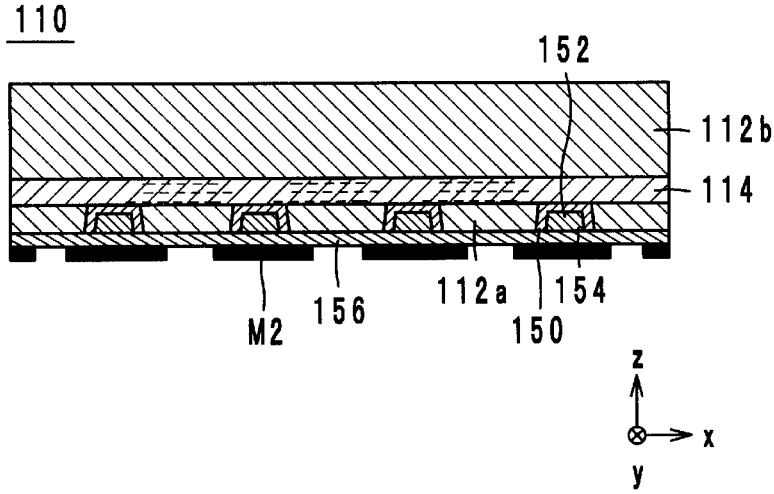

As shown in FIG. 6D, a photoresist M2 is formed on the principal surface on the negative direction side of the z axis direction of the mother main body 110. The photoresist M2 covers the region to be provided with the outer electrodes 15*a* to 15*d*.

Figure 7A:
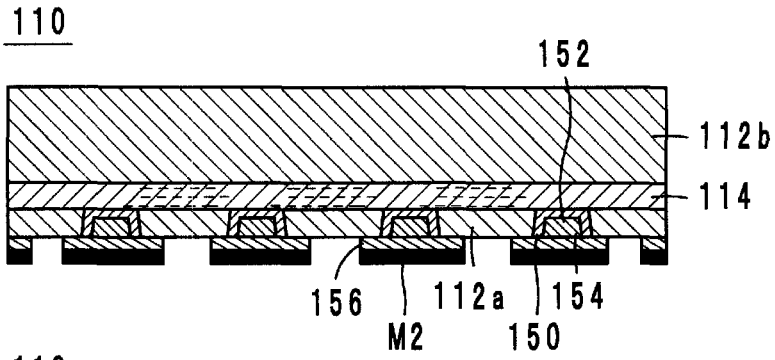
FIGS. 7A to 7D are sectional views showing steps in production of the electronic component.
Figure 7B:
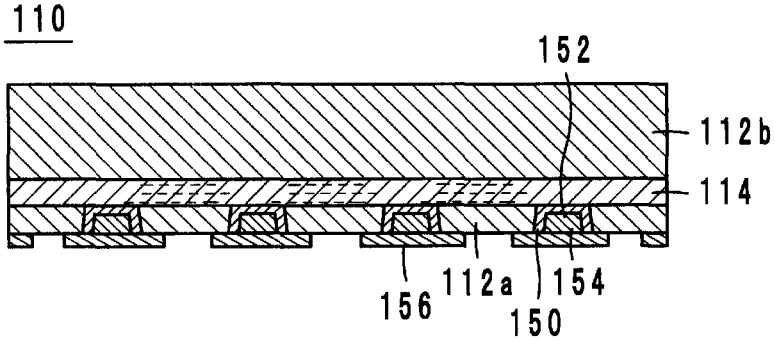

As shown in FIG. 7A, the conductor layer 156 other than the portion covered with the photoresist M2 is removed by the etching method. As shown in FIG. 7B, the photoresist M2 is removed with an organic solvent. The outer electrodes 15*a* to 15*d* are formed by forming conductor layers on the principal surface on the negative direction side of the z axis direction of the mother substrate 112*a* by the steps shown in FIG. 6C to FIG. 7B.

Figure 7C:
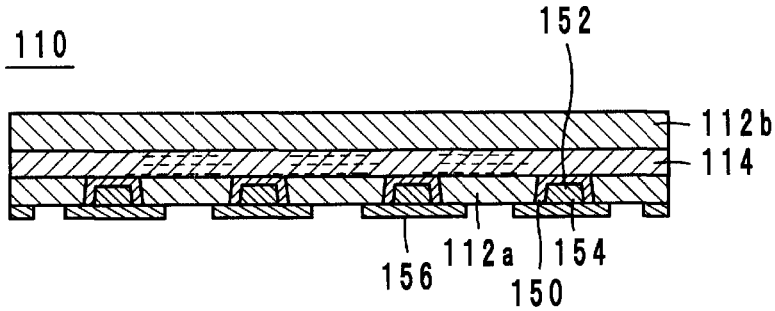

As shown in FIG. 7C, the principal surface on the positive direction side of the z axis direction of the mother substrate 112*b* is ground or polished.

Figure 7D:
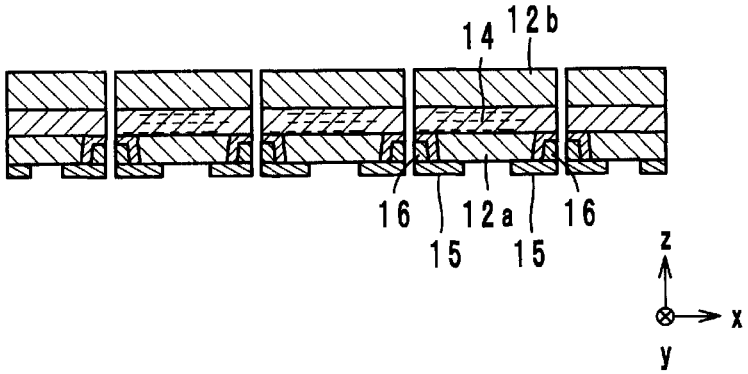

As shown in FIG. 7D, the mother main body 110 is cut with a dicer to obtain a plurality of electronic components 10. In the step shown in FIG. 7D, the dicer is allowed to pass through the Ti thin film 150, the Cu thin film 152, and the Cu plating film 154 in the through holes. Consequently, the Ti thin film 150, the Cu thin film 152, and the Cu plating film 154 are divided into the connection portions 16*a* to 16*d*. Thereafter, the electronic component 10 may be subjected to barrel polishing so as to be chamfered. Also, in order to improve the wettability, the surfaces of the outer electrodes 15*a* to 15*d* and the surfaces of the connection portions 16*a* to 16*d* may be subjected to Ni plating and Sn plating after the barrel polishing.

Advantages

According to the electronic component 10 and the method for manufacturing the same of the present embodiment, the occurrence of a break is suppressed in the electronic component 10. In more detail, in the method for manufacturing the electronic component 10, through holes are formed at positions, at which the notch portions Ca to Cd are to be formed, of the mother substrate 112*a* by the sandblast method. In the sandblast method, particles of inorganic material (alumina or SiC) are used. The lead portions 21*b*, 22*c*, 26, and 27*d* are exposed at the bottom of the through holes. Therefore, small amounts of particles remain in the bottom of the through holes and on the lead portions 21*b*, 22*c*, 26, and 27*d*. Consequently, the particles are disposed at joint portions of the lead portions 21*b*, 22*c*, 26, and 27*d* and the connection portions 16*a*, 16*b*, 16*c*, and 16*d*.

The lead portions 21*b*, 22*c*, 26, and 27*d* and the connection portions 16*a*, 16*b*, 16*c*, and 16*d* are produced from, for example, Cu. The coefficient of linear expansion of alumina or SiC is smaller than the coefficient of linear expansion of Cu. Therefore, the coefficient of linear expansion of the particle is smaller than the coefficients of linear expansion of the lead portions 21*b*, 22*c*, 26, and 27*d* and the connection portions 16*a*, 16*b*, 16*c*, and 16*d*. In the case where the coefficient of linear expansion of the particle is smaller than the coefficients of linear expansion of the lead portions 21*b*, 22*c*, 26, and 27*d* and the connection portions 16*a*, 16*b*, 16*c*, and 16*d*, as described above, in the reflow step when the electronic component 10 is mounted, the compressive stress applied between the lead portions 21*b*, 22*c*, 26, and 27*d* and the connection portions 16*a*, 16*b*, 16*c*, and 16*d* increases, as described later. As a result, the lead portions 21*b*, 22*c*, 26, and 27*d* and the connection portions 16*a*, 16*b*, 16*c*, and 16*d* are joined firmly, so that the occurrence of a break between them is suppressed.

Computer Simulation

In order to make clearer the advantages offered by the electronic component 10 and the method for manufacturing the same according to the present embodiment, the present inventor performed two types of computer simulation described below by using analytic simulation software Femtet (registered trademark) produced by Murata Software Co., Ltd.

A first computer simulation will be described. The present inventor formed a first model in which no particle was disposed and a second model in which particles were disposed. As for the second model, the present inventor formed a model in which three substantially spherical particles P1 to P3 were spaced at regular intervals, as shown in FIG. 3B. The diameters of the particles P1 to P3 were 2 μm and the material for the particles P1 to P3 was specified to be SiC. The computer simulation conditions were as listed below.

Figure 8:
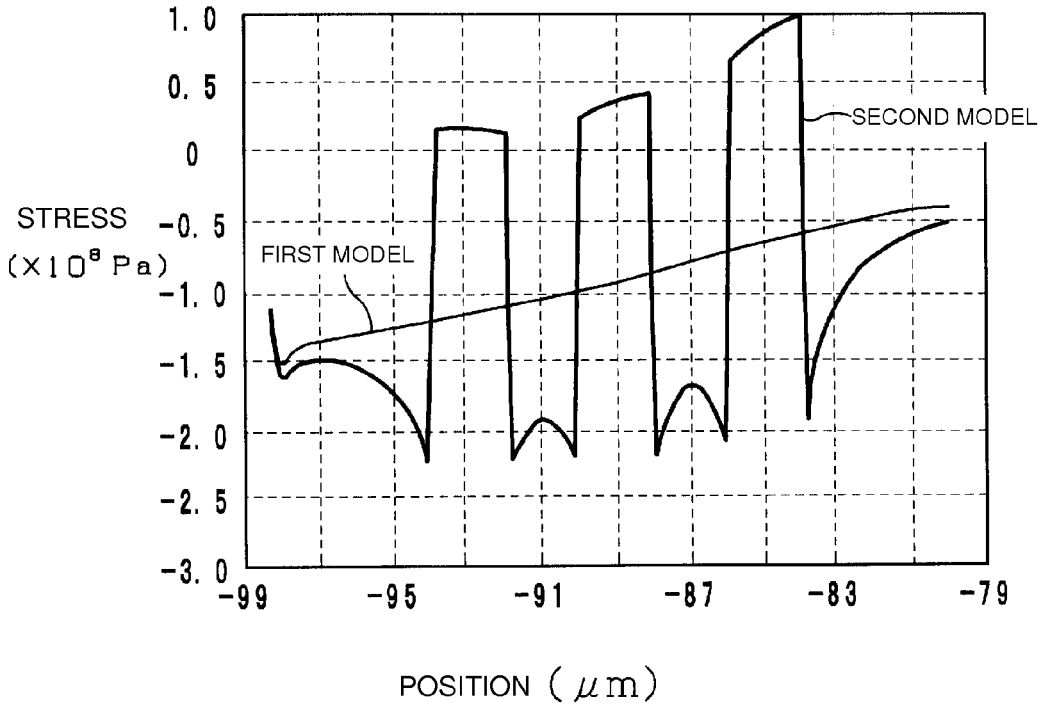
FIG. 8 is a graph showing the results of a computer simulation.

Young's modulus of SiC: $4.5\times10^{11}$ Pa
Poisson's ratio of SiC: 0.17
Coefficient of linear expansion of SiC: $6.6\times10^{-6}$/K
Young's modulus of Cu: $1.29\times10^{11}$ Pa
Poisson's ratio of Cu: 0.34
Coefficient of linear expansion of Cu: $1.4\times10^{-5}$/K
Young's modulus of Ni: $2.01\times10^{11}$ Pa
Poisson's ratio of Ni: 0.31
Coefficient of linear expansion of Ni: $1.34\times10^{-5}$/K
Young's modulus of Sn: $4.99\times10^{10}$ Pa
Poisson's ratio of Sn: 0.357
Coefficient of linear expansion of Sn: $2.30\times10^{-5}$/K Young's modulus of ferrite: $1.47\times10^{11}$ Pa
Poisson's ratio of ferrite: 0.2
Coefficient of linear expansion of ferrite: $9.50\times10^{-6}$/K
Young's modulus of polyimide: $3.30\times10^{9}$ Pa
Poisson's ratio of polyimide: 0.458
Coefficient of linear expansion of polyimide: $3.60\times10^{-5}$/K The present inventor used the first model and the second model and calculated stresses generated in the individual portions of the first model and the second model when heating was performed from 25° C. to 260° C. with the reflow step in mind. FIG. 8 is a graph showing the results of the computer simulation. The vertical axis in FIG. 8 indicates the stress and the horizontal axis in FIG. 8 indicates the position. The positive value of the stress represents that the stress is a tensile stress and the negative value represents that the stress is a compressive stress. The position represents the position along an arrow B shown in FIG. 3B. The particle P1 is located at the position of −93 μm, the particle P2 is located at the position of −89 μm, and the particle P3 is located at the position of −85 μm.

As is clear from FIG. 8, the compressive stresses applied between the particle P1 and the particle P2 and between the particle P2 and the particle P3 in the second model are larger than the compressive stresses applied to the position corresponding to the positions in the first model. That is, it is clear that large compressive stresses are generated between the particles P1 to P3 and, thereby, the lead portions 21*b*, 22*c*, 26, and 27*d* and the connection portions 16*a*, 16*b*, 16*c*, and 16*d* are joined firmly.

Next, a second computer simulation will be described. The present inventor formed a third model to a seventh model described below. The third model was the same as the first model. In the fourth model, substantially spherical SiC particles were used as the particles. In the fifth model, substantially tetragonal SiC particles were used as the particles. In the sixth model, substantially spherical alumina particles were used as the particles. In the seventh model, substantially tetragonal alumina particles were used as the particles. The arrangements in the fourth model to the seventh model were the same as the arrangement of the particles in the second model and, therefore, the explanation will not be provided. The computer simulation conditions were as listed below.

Figure 9:
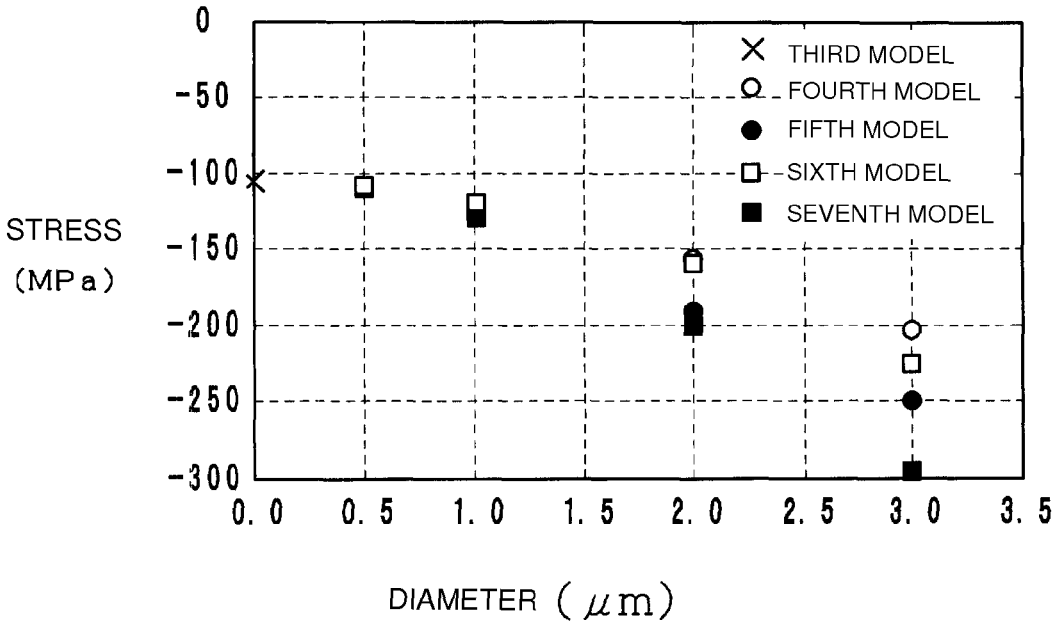
FIG. 9 is a graph showing the results of a computer simulation.

Young's modulus of SiC: $4.5\times10^{11}$ Pa
Poisson's ratio of SiC: 0.17
Coefficient of linear expansion of SiC: $6.6\times10^{-6}$/K
Young's modulus of alumina: $2.2\times10^{11}$ Pa
Poisson's ratio of alumina: 0.33
Coefficient of linear expansion of alumina: $5.4\times10^{-6}$/K
Young's modulus of Cu: $1.29\times10^{11}$ Pa
Poisson's ratio of Cu: 0.34
Coefficient of linear expansion of Cu: $1.4\times10^{-5}$/K
Young's modulus of Ni: $2.01\times10^{11}$ Pa
Poisson's ratio of Ni: 0.31
Coefficient of linear expansion of Ni: $1.34\times10^{-5}$/K
Young's modulus of Sn: $4.99\times10^{10}$ Pa
Poisson's ratio of Sn: 0.357
Coefficient of linear expansion of Sn: $2.30\times10^{-5}$/K
Young's modulus of ferrite: $1.47\times10^{11}$ Pa
Poisson's ratio of ferrite: 0.2
Coefficient of linear expansion of ferrite: $9.50\times10^{-6}$/K
Young's modulus of polyimide: $3.30\times10^{9}$ Pa
Poisson's ratio of polyimide: 0.458
Coefficient of linear expansion of polyimide: $3.60\times10^{-5}$/K The present inventor used the third model to the seventh model and calculated stresses generated at the intermediate point between the particle P1 and the particle P2 (that is, the position of −91 μm) in the third model to the seventh model when heating was performed from 25° C. to 260° C. with the reflow step in mind. At this time, the diameter of the particle was changed to 0.5 μm, 1.0 μm, 2.0 μm, and 3.0 μm. FIG. 9 is a graph showing the results of the computer simulation. The vertical axis in FIG. 9 indicates the stress and the horizontal axis in FIG. 9 indicates the diameter of the particle.

As is clear from FIG. 9, the compressive stress in the case where the alumina particles were used as the particles was larger than the compressive stresses in the case where the SiC particles were used as the particles. That is, it is clear that a break is suppressed effectively in the case where the alumina particles were used as the particles as compared with that in the case where the SiC particles were used as the particles. Here, the coefficient of linear expansion of alumina is smaller than the coefficient of linear expansion of SiC. Therefore, it is clear that a smaller coefficient of linear expansion is preferable to suppress the occurrence of a break.

As is clear from FIG. 9, the compressive stress in the case where substantially spherical particles were used was larger than the compressive stress in the case where substantially tetragonal particles were used. That is, it is clear that the occurrence of a break is suppressed effectively in the case where substantially spherical particles were used as compared with that in the case where substantially tetragonal particles were used.

Other Embodiments

The electronic component and the method for manufacturing the same according to the present disclosure are not limited to the electronic component 10 and the method for manufacturing the same according to the above-described embodiment and may be modified within the scope of the gist thereof.

The notch portions Ca to Cd are disposed in the vicinity of the ridges extending in the z axis direction of the magnetic substrate 12*a*, although the positions at which the notch portions Ca to Cd are disposed are not limited to them. The notch portions Ca to Cd may be disposed in, for example, side surfaces of the magnetic substrate 12*a* insofar as the principal surface S1 and the principal surface S2 of the magnetic substrate 12*a* are connected. The notch portions Ca to Cd may be through holes penetrating the magnetic substrate 12*a*.

The particles used for the electronic component 10 are not limited to SiC or alumina.

The lead portions 21*b*, 22*c*, 26, and 27*d* and the connection portions 16*a*, 16*b*, 16*c*, and 16*d* may be produced from a metal other than Cu. Examples of metals other than Cu include Ag and Au.

The electronic component 10 is provided with two coils L1 and L2, although the number of coils disposed in the electronic component 10 is not limited to this. The number of coils may be 1 or 3 or more.

INDUSTRIAL APPLICABILITY

As described above, the present disclosure is useful for the electronic component and the method for manufacturing the same and, in particular, is excellent at suppressing the occurrence of a break.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a first magnetic substrate in the shape of a rectangular parallelepiped having a first principal surface and a second principal surface opposite to each other and provided with a first notch portion and a second notch portion connecting the first principal surface and the second principal surface;

a multilayer body including a plurality of insulator layers stacked on the first principal surface;

a coil disposed in the multilayer body and including a coil portion, a first lead portion, and a second lead portion, the first lead portion and the second lead portion being connected to a respective one of two end portions of the coil portion and overlapping the first notch portion and the second notch portion, respectively, in plan view when viewed from a stacking direction;

a first outer electrode and a second outer electrode disposed on the second principal surface;

a first connection portion and a second connection portion connecting the first outer electrode to the first lead portion and the second outer electrode to the second lead portion, respectively, and being disposed on an inner periphery of the first notch portion and an inner periphery of the second notch portion, respectively; and particles disposed at a joint portion of the first lead portion and the first connection portion and a joint portion of the second lead portion and the second connection portion and having a coefficient of linear expansion smaller than coefficients of linear expansion of the first lead portion, the second lead portion, the first connection portion, and the second connection portion.

2. A method for manufacturing an electronic component including a first magnetic substrate in the shape of a rectangular parallelepiped having a first principal surface and a second principal surface opposite to each other and provided with a first notch portion and a second notch portion connecting the first principal surface and the second principal surface;

a multilayer body including a plurality of insulator layers stacked on the first principal surface;

a coil disposed in the multilayer body and including a coil portion, a first lead portion, and a second lead portion, the first lead portion and the second lead portion being connected to a respective one of two end portions of the coil portion and overlapping the first notch portion and the second notch portion, respectively, in plan view when viewed from a stacking direction;

a first outer electrode and a second outer electrode disposed on the second principal surface;

a first connection portion and a second connection portion connecting the first outer electrode to the first lead portion and the second outer electrode to the second lead portion, respectively, and being disposed on an inner periphery of the first notch portion and an inner periphery of the second notch portion, respectively; and particles disposed at a joint portion of the first lead portion and the first connection portion and a joint portion of the second lead portion and the second connection portion and having a coefficient of linear expansion smaller than coefficients of linear expansion of the first lead portion, the second lead portion, the first connection portion, and the second connection portion, the method comprising the steps of:

preparing a mother main body in which a mother multilayer body serving as the multilayer body is disposed on the first principal surface of a first mother substrate serving as the first magnetic substrate;

forming through holes at positions, at which the first notch portion and the second notch portion are to be formed, of the first mother substrate by using the particles;

forming the first connection portion and the second connection portion by forming conductor layers on the inner peripheries of the through holes;

forming the first outer electrode and the second outer electrode by forming conductor layers on the principal surface of the first mother substrate; and cutting the mother main body.

3. The electronic component according to claim 1, wherein the particles are made from an inorganic substance.

4. The electronic component according to claim 1, wherein the particles are made from SiC or alumina.

5. The electronic component according to claim 1, wherein the particles have spherical shapes.

6. The method for manufacturing the electronic component according to claim 2, wherein the particles are made from an inorganic substance.

7. The method for manufacturing the electronic component according to claim 6, wherein the particles are made from SiC or alumina.

8. The method for manufacturing the electronic component according to claim 6, wherein the particles have spherical shapes.

* * * * *